US008578947B2

(12) United States Patent
Kim

(10) Patent No.: US 8,578,947 B2
(45) Date of Patent: Nov. 12, 2013

(54) COSMETIC CASE WITH STERILIZER AND PUFF

(76) Inventor: Sang Seon Kim, Incheon (KR)

( * ) Notice: Subject to any disclaimer, the term of this patent is extended or adjusted under 35 U.S.C. 154(b) by 0 days.

(21) Appl. No.: 13/422,798

(22) Filed: Mar. 16, 2012

(65) Prior Publication Data

US 2012/0234346 A1 Sep. 20, 2012

(30) Foreign Application Priority Data

Mar. 18, 2011 (KR) ..... 10-2011-0024547

(51) Int. Cl.
*A45D 33/00* (2006.01)
*A45D 33/02* (2006.01)

(52) U.S. Cl.
USPC ..... 132/293; 132/298

(58) Field of Classification Search
USPC ..... 132/293, 294, 295, 298, 299, 305; 206/823, 581
See application file for complete search history.

(56) References Cited

U.S. PATENT DOCUMENTS

2001/0032655 A1* 10/2001 Gindi ..... 132/293

* cited by examiner

*Primary Examiner* — Rachel Steitz
(74) *Attorney, Agent, or Firm* — John K. Park; Park Law Firm

(57) ABSTRACT

The present invention relates to a cosmetic case with a sterilizer and a puff, and more particularly, a cosmetic case including a puff and a sterilizer for sterilizing the puff. The cosmetic case with the sterilizer and the puff according to the present invention is capable of sterilizing the puff combined to the case body with the ultraviolet ray from the sterilizer to prevent bacterial contamination and proliferation of the puff, thereby improving sanitation and storage quality, and is capable of frequent sterilization before and after use of cosmetics, thereby improving user's convenience for sterilization of the puff.

6 Claims, 6 Drawing Sheets

COSMETIC CASE WITH STERILIZER AND PUFF

CROSS-REFERENCE TO RELATED APPLICATION

This application claims the benefit of Korean Application No. 10-2011-0024547, filed on Mar. 18, 2011, with the Korean Intellectual Property Office, the disclosure of which is incorporated herein by reference.

BACKGROUND OF THE INVENTION

1. Field of the Invention

The present invention relates to a cosmetic case with a sterilizer and a puff, and more particularly, a cosmetic case including a puff and a sterilizer for sterilizing the puff.

2. Description of the Related Art

In general, cosmetics may be divided into fundamental cosmetics such as skin toners, lotions and the like, make-up cosmetics such as powers, compacts and the like, and functional cosmetics for prevention of wrinkles and aging, and their contents are in the form of viscous liquid, solid, power or gel.

Such cosmetics are stored in a case made of material such as plastics, vinyl, synthetic resin, metal, ceramics or the like.

A cosmetic case storing make-up cosmetics includes a separate puff for use of powders or foundations in the form of power or liquid. As used herein, the term "puff" refers to a make-up tool used to apply powers or foundations to a skin.

However, a puff equipped in conventional cosmetic cases contains a quantity of water and oil in the course of contact with a skin, which may provide surroundings favorable for introduction and proliferation of external contaminants such as bacteria. Such a puff contaminated by bacteria may have an adverse effect on the skin, such as causing a skin trouble or accelerating a skin aging.

SUMMARY OF THE INVENTION

Accordingly, it is an object of the present invention to provide a cosmetic case with a puff and a sterilizer, which is capable of sterilizing the puff integrally combined to the cosmetic case, thereby improving sanitation and storage quality of the puff.

To achieve the above objects, according to an aspect of the invention, there is provided a cosmetic case with a sterilizer and a puff, including: a case body including a cosmetic storage which stores powdered cosmetics and is formed to open its top side, and a puff combiner which is detachably combined to the upper side of the cosmetic storage and has an internal cosmetic discharge passage; a puff including an upper puff and a lower puff which has a plurality of supply holes and is joined to the upper puff, the lower puff being integrally combined to the top of the puff combiner such that cosmetics are supplied; a case over cap which has an internal storage space and is detachably combined to the top of the puff combiner combining the puff; a sterilizer which is provided in the storage space and emits an ultraviolet ray to sterilize the puff; a power supply which is disposed within the storage space for supplying power to the sterilizer; and an operation indicator which is provided to indicate operation conditions of the sterilizer according to a control signal from the power supply.

Preferably, the case over cap includes a cover which is combined to the storage space and has a power button to turn on/off the sterilizer, the power supply includes: a printed circuit board which is stored in the storage space and has the bottom combined with the sterilizer; and a printed circuit board cover which is combined to the storage space to fix the printed circuit board to the storage space and has the bottom combined with the operation indicator, the operation indicator is formed with a light emitting diode which is turned on for sterilization of the puff by the sterilizer and is turned off after completion of the sterilization of the puff, and the printed circuit board cover has a penetrating light transmission hole which is inserted with the operation indicator and diffuses light toward the cover.

Preferably, power button is formed to be transparent or translucent to allow a user to see the light diffused from the operation indicator from the outside of the cover.

Preferably, the case over cap includes a plurality of projecting screw fixers which are spaced from each other with predetermined intervals in the circumference of the bottom of the storage space and are formed to have the height corresponding to the thickness of the sterilizer, and The printed circuit board cover is combined to the storage space via fixing screws screwed to the screw fixers through the printed circuit board.

Preferably, the case over cap includes a penetrating ultraviolet irradiation hole formed on the bottom of the storage space in a manner to correspond to the sterilizer so that the puff can be irradiated with an ultraviolet ray emitted from the sterilizer, and a plurality of penetrating ejection holes formed around the ultraviolet irradiation hole, and the printed circuit board cover includes at least one piezoelectric battery which is combined to the top and supplies power to the sterilizer according to actuation of the power button.

According to another aspect of the invention, there is provided a cosmetic case with a sterilizer and a puff, including: a case body including a cosmetic tube container which stores liquefied cosmetics and is formed to open its top side, and a puff combiner which is detachably combined to the upper side of the cosmetic tube container and has an internal cosmetic discharge passage; a puff which is joined to the top of the puff combiner such that cosmetics are supplied and has a discharge hole formed in its top and center portion; a case over cap which has an internal storage space and is detachably combined to the top of the puff combiner combining the puff; a sterilizer which is provided in the storage space and emits an ultraviolet ray to sterilize the puff; a power supply which is disposed within the storage space for supplying power to the sterilizer; and an operation indicator which is provided to indicate operation conditions of the sterilizer according to a control signal from the power supply.

The cosmetic case with the sterilizer and the puff according to one embodiment of the present invention is capable of sterilizing the puff combined to the case body with the ultraviolet ray from the sterilizer to prevent bacterial contamination and proliferation of the puff, thereby improving sanitation and storage quality, and is capable of frequent sterilization before and after use of cosmetics, thereby improving user's convenience for sterilization of the puff.

The above and/or other aspects and advantages of the present invention will become apparent and more readily appreciated from the following description of the embodiments, taken in conjunction with the accompanying drawings.

DETAILED DESCRIPTION OF THE PREFERRED EMBODIMENT

Hereinafter, preferred embodiments of the present invention will be described in detail with reference to the accompanying drawings. In the following detailed description, concrete description on related functions or constructions will be omitted if it is deemed that the functions and/or constructions may unnecessarily obscure the gist of the present invention.

Figure 1:
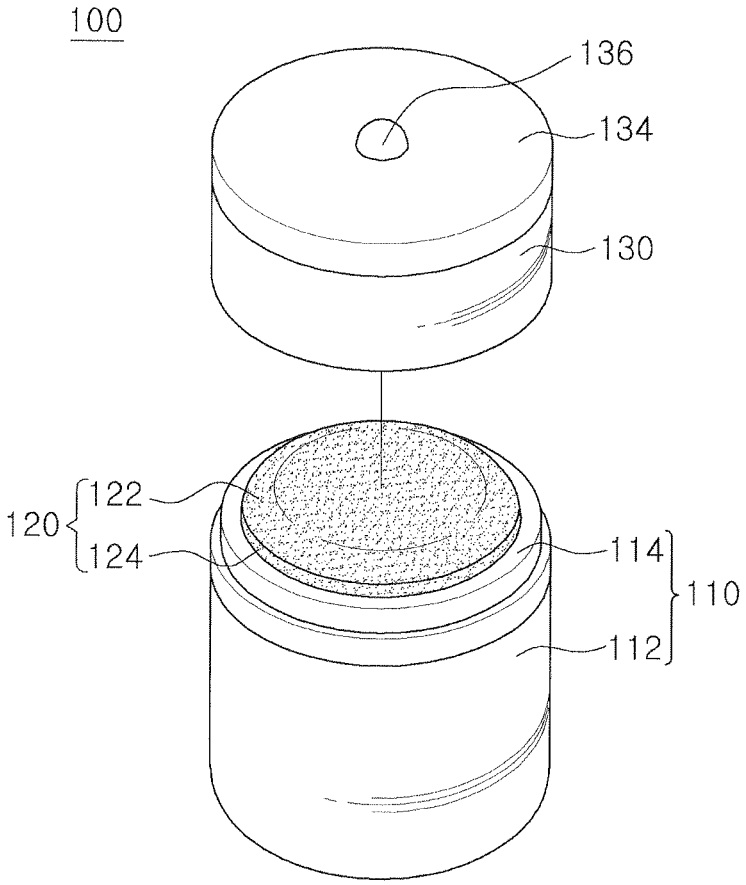
FIG. 1 is a cosmetic case with a sterilizer and a puff according to one embodiment of the present invention.
Figure 2:
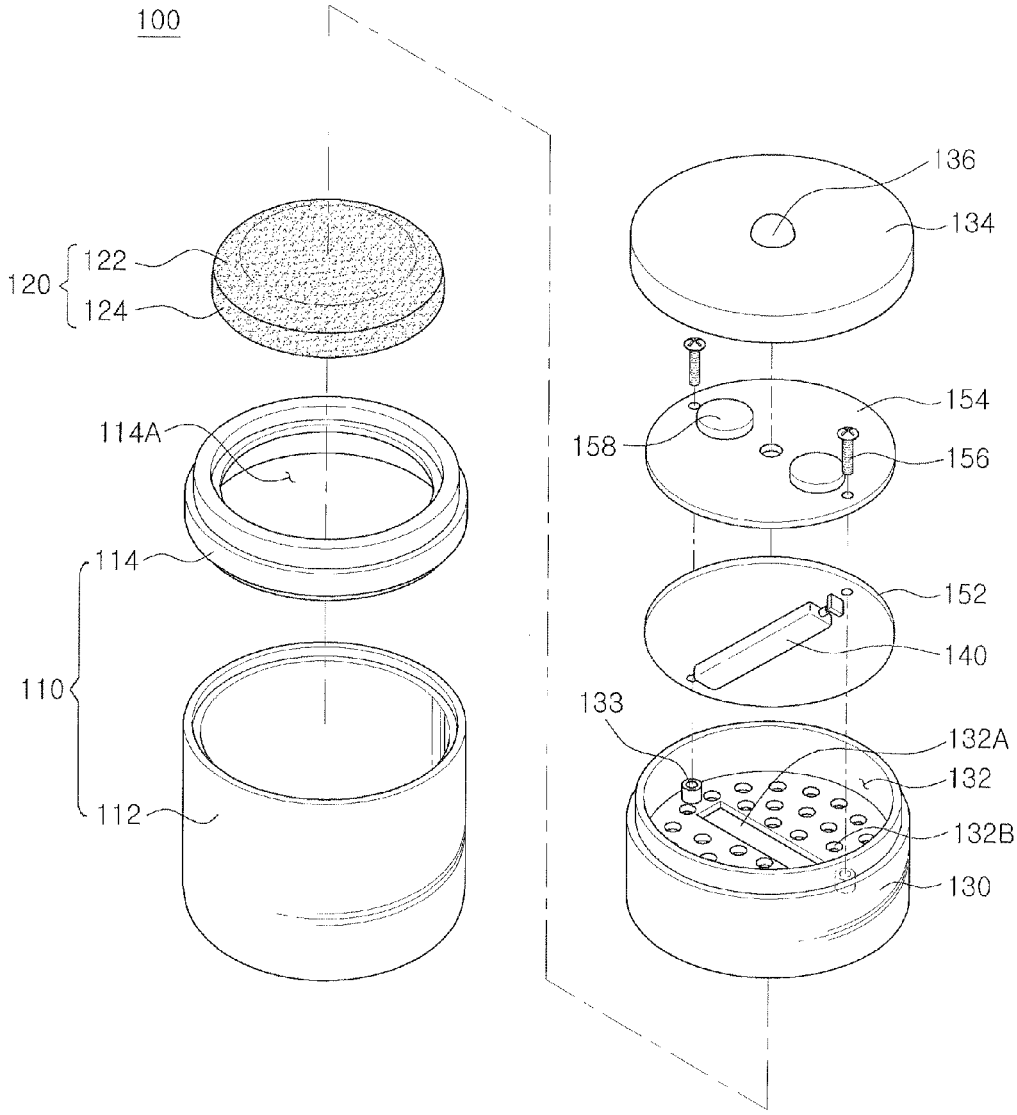
FIG. 2 is an exploded perspective view of the cosmetic case shown in FIG. 1.
Figure 3:
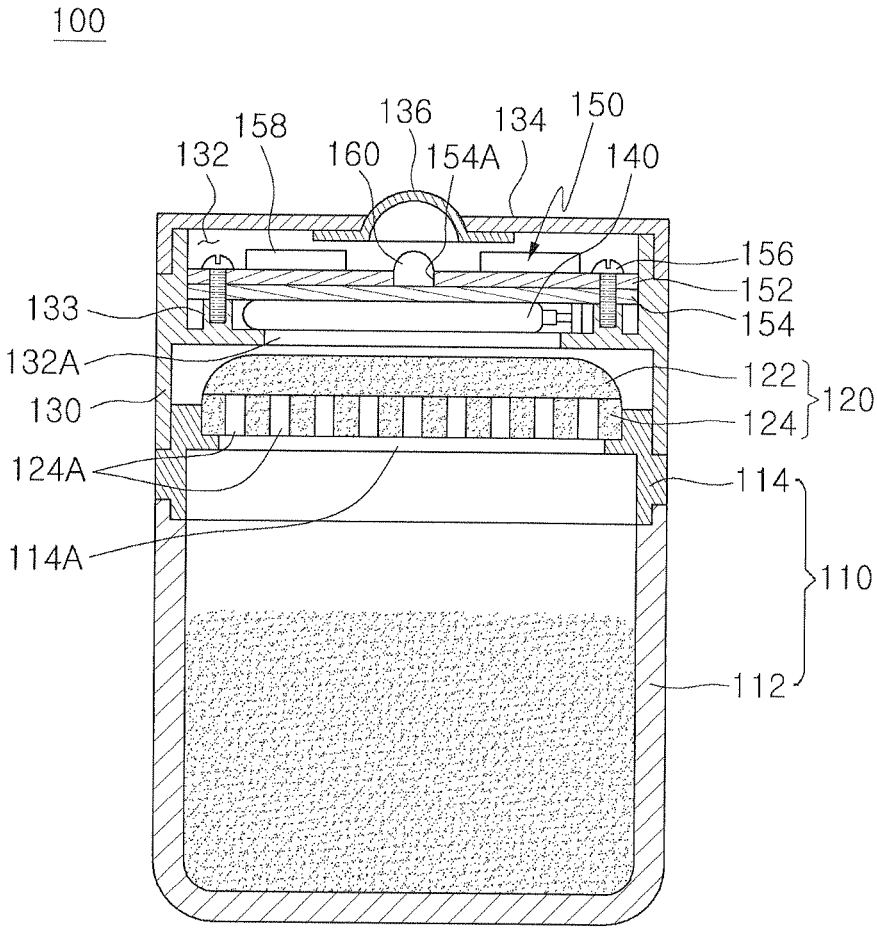
FIG. 3 is a sectional view of the cosmetic case shown in FIG. 1.
Figure 4:
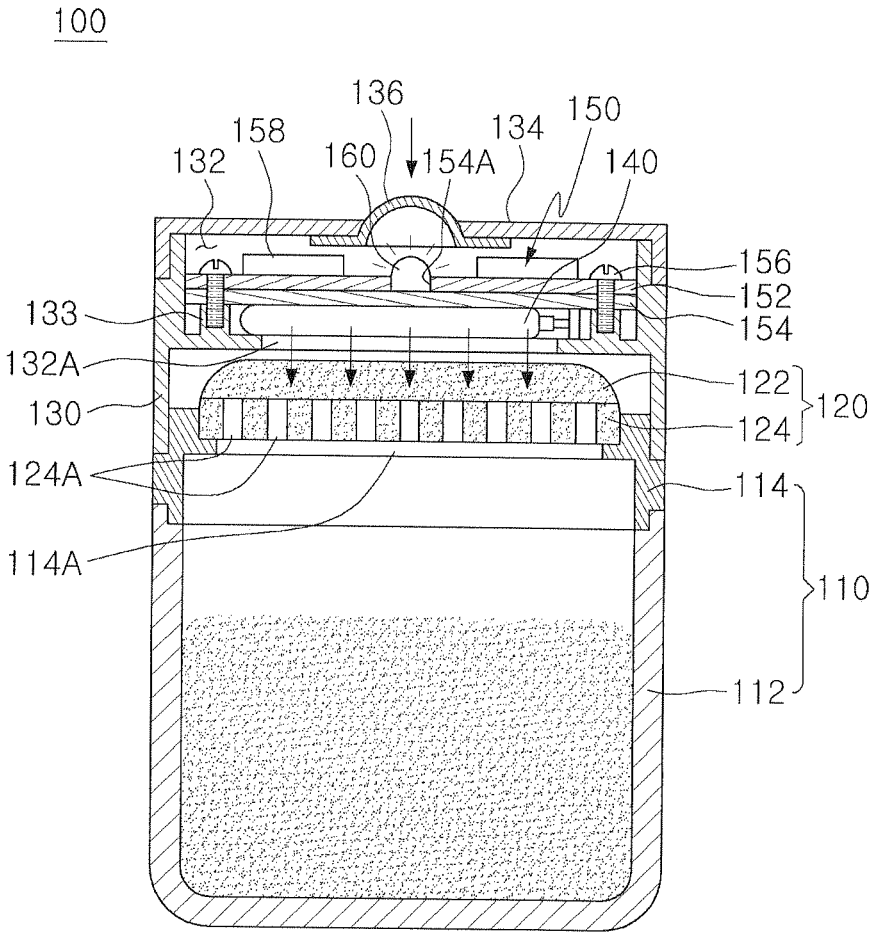
FIG. 4 is a view showing a use condition of the cosmetic case with the sterilizer and the puff shown in FIG. 1.

FIG. 1 is a cosmetic case with a sterilizer and a puff according to one embodiment of the present invention, FIG. 2 is an exploded perspective view of the cosmetic case shown in FIG. 1, FIG. 3 is a sectional view of the cosmetic case shown in FIG. 1, and FIG. 4 is a view showing a use condition of the cosmetic case with the sterilizer and the puff shown in FIG. 1.

Referring to FIGS. 1 to 3, a cosmetic case 100 according to one embodiment of the present invention includes a case body 110 in which cosmetics are stored, a puff 120 combined to the case body 110 for supplying the cosmetics, a case over cap 130 which has a storage space 132 formed therein and is combined to the case body 110 for use or storage of the puff 120, a sterilizer 140 which is disposed within the storage space 132 for sterilizing the puff 120, a power supply 150 which is disposed within the storage space 132 for supplying power to the sterilizer 140, and an operation indicator which is provided to indicate operation conditions of the sterilizer 140 according to a control signal from the power supply 150.

The case body 110 forms a main frame of the cosmetic case and includes a cosmetic storage 112 and a puff combiner 114 which is combined to the cosmetic storage 112 for placement of the puff 120.

The cosmetic storage 112 stores the cosmetics in the form of powers and is formed to open its top side. For example, the cosmetic storage 112 stores make-up cosmetics such as powders.

The puff combiner 114 is detachably combined to the upper side of the cosmetic storage 112 and has an internal penetrating cosmetic discharge passage 114A through which the cosmetics stored in the cosmetic storage 112 are discharged and supplied to the puff 120.

The puff combiner 114 has the bottom screwed to the top of the cosmetic storage 112 so that it can be attached/detached to/from the cosmetic storage 112.

The puff 120 is provided to apply the cosmetics discharged and supplied from the cosmetic storage 112 to a skin and includes an upper puff 122 and a lower puff 124 joined to the bottom of the upper puff 122.

The upper puff 122 is provided to apply the cosmetics supplied from the cosmetic storage 112 to the skin and is joined to the lower puff 124.

The lower puff 124 is provided to supply the cosmetics discharged from the cosmetic storage 112 to the upper puff 122 and is integrally combined to the top of the puff combiner 114.

The lower puff 124 has a surface formed thereon with a plurality of supply holes 124A through which the cosmetics discharged through the cosmetic discharge passage 114A of the puff combiner 114 can be supplied to the upper puff 122. Thus, the cosmetics are supplied to the upper puff 122 through the supply holes 124A of the lower puff 124.

Here, the upper puff 122 and the lower puff 124 are joined together via a harmless natural adhesive and the lower puff 124 joined to the upper puff 122 is integrally combined to the top of the puff combiner 114 via a natural adhesive.

The case over cap 130 is detachably combined to the top of the puff combiner 114 combined to the puff 120 and includes an internal storage space 132 and a cover 134 combined to the storage space 132.

Here, the case over cap 130 has the bottom screwed to the top of the puff combiner 114. Thus, the case over cap 130 has a structure attached/detached to/from the puff combiner 114*d*.

The case over cap 130 is separated from the puff combiner 114 when the puff 120 is used, and is combined to the puff combiner 114 so that the puff 120 can be stored after the puff 120 has been used.

The storage space 132 is formed to be dented on the top of the case over cap 130 and provides a space where the sterilizer 140 and the power supply 150 are stored.

The storage space 132 has a penetrating ultraviolet irradiation hole 132A formed on the bottom corresponding to the sterilizer 140 and through which the puff 120 is irradiated with an ultraviolet ray emitted from the sterilizer 140, and a plurality of ejection holes 132B which penetrate through the bottom of the storage space 132 and are spaced from each other with predetermined intervals around the ultraviolet irradiation hole 132A.

That is, the ultraviolet irradiation hole 132A provides a passage through which the puff 120 is irradiated with the ultraviolet emitted from the sterilizer 140, and the plurality of ejection holes 132B provides a passage through which heat and smell generated in actuation of the sterilizer 140 are ejected externally.

On the bottom of the storage space 132 is formed a plurality of projecting screw fixers 133 which are spaced from each other with predetermined intervals in the circumference. The screw fixers 133 are formed to have the height corresponding to the thickness of the sterilizer 140.

The cover 134 is formed with a power button 136 which is combined to the top of the storage space and actuates the sterilizer 140.

The power button 136 is provided to actuate the sterilizer 140 emitting the ultraviolet ray and is transparent or translucent.

The sterilizer 140 is actuated when the power button 136 is pressed, while being deactivated when the power button 136 is pressed again. Accordingly, the sterilizer 140 can be frequently actuated to sterilize the puff 120 according to the manipulation of the power button 136.

The sterilizer 140 is combined to the power supply 150 such that the puff 120 is sterilized by being irradiated with the ultraviolet ray. That is, the sterilizer 140 can prevent bacterial contamination and proliferation of the puff 120 by irradiating the puff 120 with the ultraviolet ray.

In this embodiment, the sterilizer 140 is formed with a UV lamp to emit an ultraviolet ray to sterilize the puff 120. In other embodiments, the sterilizer 140 may be formed with an ozone lamp capable of powerful deodorization and sterilization of non-irradiated surfaces that an ultraviolet ray cannot reach.

The power supply 150 is provided to supply power to the sterilizer 140 and includes a printed circuit board 152 and a cover 154 covering the printed circuit board 152.

The printed circuit board 152 is stored in the storage space 132 and has the bottom combined with the sterilizer 140.

In this embodiment, the printed circuit board 152 may have various configurations to supply and cut off power to the sterilizer 140 under control of the power button 136. Such various configurations are known to those skilled in the art and therefore explanation of which will be omitted for the purpose of brevity.

The cover 154 is combined to the storage space 132 via fixing screws 156 so that it can cover the printed circuit board 152.

The fixing screws 156 are screwed to the screw fixers 133 in both sides of the cover 154 through the printed circuit board 152.

In this case, the fixing screws 156 are screwed to the screw fixers 133 in such a manner that the fixing screws 156 do not penetrate through the bottom of the storage space 132, thereby preventing the puff 120 from being contaminated due to rusts and alien substances generated in the fixing screws 156, which may result in hygienic storage of the puff 120.

Of course, depth of screw connection of the fixing screws 156 may be varied as necessary.

The cover 154 has a penetrating light transmission hole 154A formed in the center to diffuse light emitted in turning-on of an operation indicator 160 toward the cover 134.

That is, the operation indicator 160 is provided to be inserted in the light transmission hole 154A and the light emitted in turning-on of the operation indicator 160 is diffused toward the cover 134. Accordingly, a user can confirm operation conditions of the operation indicator 160 by naked eyes through the transparent or translucent power button 136 from the outside of the cover 134.

The cover 154 has the top combined with at least one battery 158 to supply power to the sterilizer 140 according to actuation of the power button 136. In this embodiment, the battery 158 may be a piezoelectric battery to minimize thickness of the cover 154.

The operation indicator 160 is combined to the top of the printed circuit board 152 so that the user can see operation conditions of the sterilizer 140 according to a control signal from the power supply 150. When the printed circuit board 152 is fixed to the storage space 132 with the cover 154, the operation indicator 160 is inserted in and combined to the light transmission hole 154A. Accordingly, the operation indicator 160 diffuses the light emitted depending on the operation of the sterilizer 140 toward the cover 134. In this embodiment, the operation indicator 160 is formed with a light emitting diode which is turned on for sterilization of the puff 120 by the sterilizer 140 and is turned off after completion of the sterilization of the puff 120.

In other embodiments, the operation indicator 160 may be provided in a manner to produce a sound during operation of the sterilizer 140.

Hereinafter, a use condition of the cosmetic case with the sterilizer and the puff according to one embodiment of the present invention will be described with reference to FIG. 4.

In the cosmetic case 100 with the sterilizer and the puff in this embodiment, the case over cap 130 having the sterilizer 140 is detachably combined to the top of the case body 110 integrally combined with the puff 120 to apply the cosmetics to the skin.

As shown in FIG. 4, when the power button 136 combined to the cover 134 is pressed to sterilize the puff 120 provided in the case body 110, power is supplied from the power supply 150 stored in the storage space 132 of the case over cap 130 to the sterilizer 140, thereby actuating the sterilizer 140.

When the sterilizer 140 is actuated, the sterilizer 140 emits a large quantity of ultraviolet ray with which the puff 120 is irradiated. That is, the sterilizer 140 irradiates the puff 120 with the ultraviolet ray emitted according to supply of the power through the ultraviolet irradiation hole 132A formed in the bottom of the storage space 132, thereby sterilizing the puff 120 to prevent bacterial contamination and proliferation of the puff 120.

Such emission of the ultraviolet ray by the sterilizer 140 continues to proceed while the power button 136 is being pressed, and is stopped when the power button 136 is pressed again.

That is, the sterilizer 140 is actuated according to supply of the power from the power supply 150 to emit the ultraviolet ray to sterilize the puff 120 when the power button 136 is pressed, and is stopped when the power button 136 is pressed again.

During sterilization of the puff 120 by the sterilizer 140, the operation indicator 160 combined to the printed circuit board 152 of the power supply 150 is turned on to be activated along with the sterilizer 140 according to the control signal from the power supply 150 when the power button 136 is pressed, thereby diffusing the light toward the cover 134, and is turned off to be deactivated along with the sterilizer 140 when the power button 136 is pressed again.

That is, since the operation indicator 160 is actuated depending on the operation of the sterilizer 140 to diffuse the light toward the cover 134, it is possible for the user to confirm operation conditions of the sterilizer 140 by naked eyes through the transparent or translucent power button 136 from the outside of the cover 134.

When the cosmetics stored in the cosmetic storage 112 of the case body 110 are exhausted, the puff combiner 114 may be separated from the case body 110 and additional cosmetics may be stored in the cosmetic storage 112.

The cosmetic case 100 with the sterilizer and the puff according to one embodiment of the present invention is capable of sterilizing the puff 120 combined to the case body 110 with the ultraviolet ray from the sterilizer 140 to prevent bacterial contamination and proliferation of the puff 120, thereby improving sanitation and storage quality, and is capable of frequent sterilization before and after use of cosmetics, thereby improving user's convenience for sterilization of the puff 120.

Figure 5:
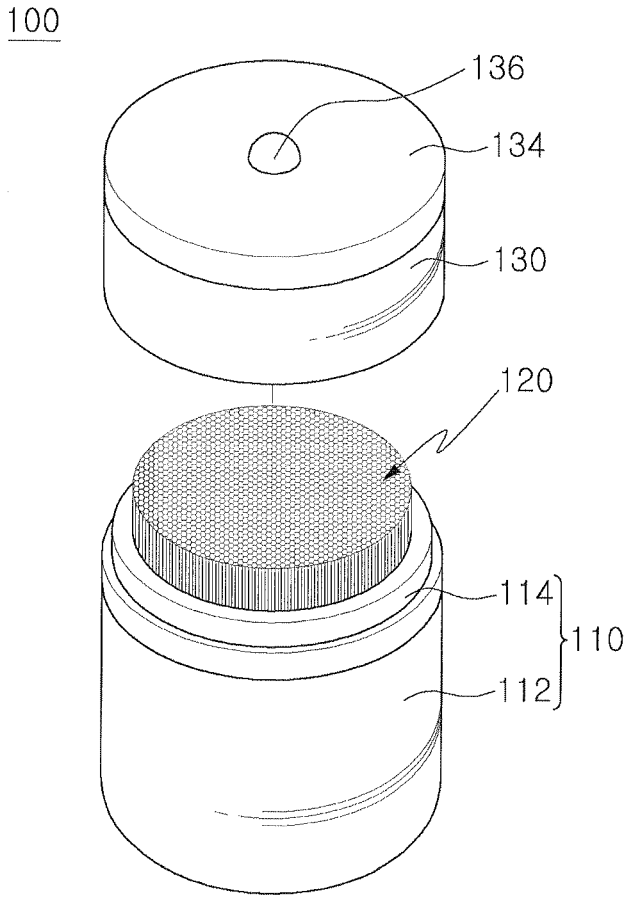
FIGS. 5 and 6 are perspective views showing other embodiments of the cosmetic case with the sterilizer and the puff shown in FIG. 1.
Figure 6:
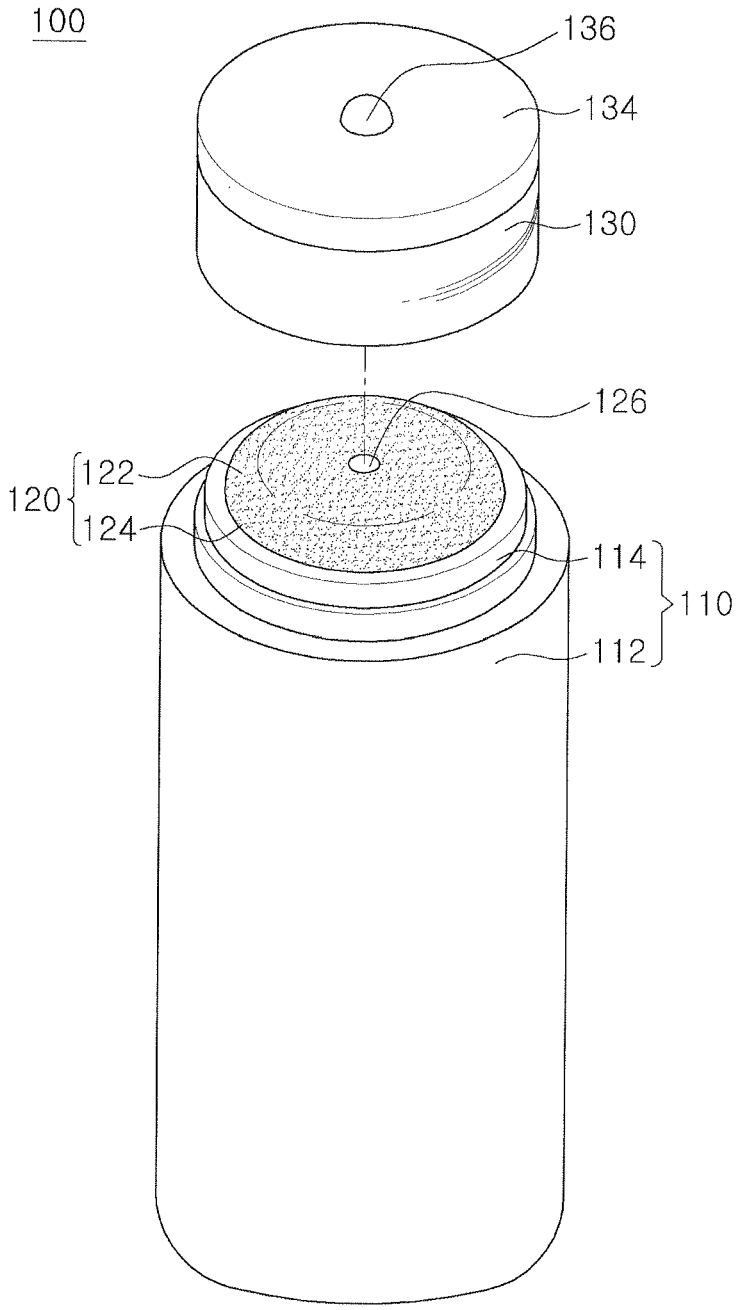

FIGS. 5 and 6 are perspective views showing other embodiments of the cosmetic case with the sterilizer and the puff shown in FIG. 1.

As an alternative embodiment, as shown in FIG. 5, the cosmetic case 100 includes a brush type puff 120 combined to the case body 110.

As another alternative embodiment, as shown in FIG. 6, the cosmetic case 100 has an integrated (sponge type) structure where the cosmetic storage 112 of the case body 110 is formed with a cosmetic tube container to store cosmetics such as foundations in the form of liquid, and the puff 120 has a discharge hole 126 formed in its top and center portion.

In these alternative embodiments, the puff 120 is formed with a single structure, unlike the above-described embodiment providing the complex structure where the upper puff 122 is joined to the lower puff 124.

In this manner, without being limited to the above-described embodiment, the cosmetic case 100 of the present invention can be applied to various kinds of cosmetic cases 100 with the puff 120 to apply powered or liquefied cosmetics to a skin.

While the present invention has been particularly shown and described with reference to exemplary embodiments thereof, it will be understood by those skilled in the art that various changes in form and details may be made therein without departing from the spirit and scope of the present invention. The exemplary embodiments are provided for the purpose of illustrating the invention, not in a limitative sense. Thus, it is intended that the present invention covers the modifications and variations of this invention provided they come within the scope of the appended claims and their equivalents.

What is claimed is:

1. A cosmetic case with a sterilizer and a puff, comprising:

a case body including a cosmetic storage which stores powdered cosmetics and is formed to open its top side, and a puff combiner which is detachably combined to an upper side of the cosmetic storage and has an internal cosmetic discharge passage;

a puff including an upper puff and a lower puff which has a plurality of supply holes and is joined to the upper puff, the lower puff being integrally combined to a top of the puff combiner such that cosmetics are supplied;

a case over cap which has an internal storage space and is detachably combined to the top of the puff combiner combining the puff;

a sterilizer which is provided in the internal storage space and emits an ultraviolet ray to sterilize the puff;

a power supply which is disposed within the internal storage space for supplying power to the sterilizer; and an operation indicator which is provided to indicate operation conditions of the sterilizer according to a control signal from the power supply.

2. The cosmetic case according to claim 1, wherein the case over cap includes a cover which is combined to the storage space and has a power button to turn on/off the sterilizer, the power supply includes:

a printed circuit board which is stored in the storage space and has a bottom combined with the sterilizer; and a printed circuit board cover which is combined to the internal storage space to fix the printed circuit board to the internal storage space and has the bottom combined with the operation indicator, the operation indicator is formed with a light emitting diode which is turned on for sterilization of the puff by the sterilizer and is turned off after completion of the sterilization of the puff, and the printed circuit board cover has a penetrating light transmission hole which is inserted with the operation indicator and diffuses light toward the cover.

3. The cosmetic case according to claim 2, wherein the power button is formed to be transparent or translucent to allow a user to see the light diffused from the operation indicator from the outside of the cover.

4. The cosmetic case according to claim 2, wherein the case over cap includes a plurality of projecting screw fixers which are spaced from each other with predetermined intervals in a circumference of the bottom of the internal storage space and are formed to have a height corresponding to a thickness of the sterilizer, and the printed circuit board cover is combined to the internal storage space via fixing screws screwed to the screw fixers through the printed circuit board.

5. The cosmetic case according to claim 2, wherein the case over cap includes a penetrating ultraviolet irradiation hole formed on the bottom of the internal storage space in a manner to correspond to the sterilizer so that the puff can be irradiated with an ultraviolet ray emitted from the sterilizer, and a plurality of penetrating ejection holes formed around the ultraviolet irradiation hole, and the printed circuit board cover includes at least one piezoelectric battery which is combined to the top of the puff combiner and supplies power to the sterilizer according to actuation of the power button.

6. A cosmetic case with a sterilizer and a puff, comprising:

a case body including a cosmetic tube container which stores liquefied cosmetics and is formed to open its top side, and a puff combiner which is detachably combined to an upper side of the cosmetic tube container and has an internal cosmetic discharge passage;

a puff which is joined to a top of the puff combiner such that cosmetics are supplied and has a discharge hole formed in its top and center portion;

a case over cap which has an internal storage space and is detachably combined to the top of the puff combiner combining the puff;

a sterilizer which is provided in the internal storage space and emits an ultraviolet ray to sterilize the puff;

a power supply which is disposed within the internal storage space for supplying power to the sterilizer; and an operation indicator which is provided to indicate operation conditions of the sterilizer according to a control signal from the power supply.

* * * * *